US005495875A

United States Patent [19]

Benning et al.

[11] Patent Number: 5,495,875

[45] Date of Patent: Mar. 5, 1996

[54] SYSTEM FOR CONTINUOUS BLENDING OF A LIQUID INTO A GAS

[75] Inventors: Michael A. Benning, Allentown; Stephen B. Miller, Doylestown, both of Pa.

[73] Assignee: Scott Specialty Gases, Inc., Plumsteadville, Pa.

[21] Appl. No.: 347,636

[22] Filed: Dec. 1, 1994

[51] Int. Cl.[6] ..... B65B 31/00

[52] U.S. Cl. ..... 141/83; 141/3; 141/9; 141/11; 141/18; 141/82; 141/100; 141/105; 141/197; 137/3; 137/88; 137/606; 261/16; 261/27; 261/30; 261/152

[58] Field of Search ..... 141/3, 9, 11, 18, 141/20, 21, 25, 82, 83, 100, 105, 107, 2, 70, 197; 137/3–7, 88, 93, 334, 606, 607; 261/16, 27, 30, 152, DIG. 7; 222/145.5, 145.6, 146.6

[56] References Cited

U.S. PATENT DOCUMENTS

| | | | |
|---|---|---|---|
| 2,042,991 | 6/1936 | Harris, Jr. | 261/27 |
| 2,529,942 | 11/1950 | Holthouse | 261/30 |
| 2,588,677 | 3/1952 | Welty et al. | 261/27 |
| 2,782,992 | 2/1957 | Gustafson | 261/30 |
| 3,072,389 | 1/1963 | MacInnes | 261/30 |
| 3,136,325 | 6/1964 | Mattix | 137/3 |
| 3,502,118 | 3/1970 | Assalit | 141/20 |
| 3,710,771 | 1/1973 | Cinquegrani | 261/27 X |
| 3,734,111 | 5/1973 | McClintock | 137/3 |
| 3,771,260 | 11/1973 | Arenson | 261/16 |
| 3,779,261 | 12/1973 | Zygiel | 137/3 |
| 3,835,873 | 9/1974 | Wildpaner | 137/3 |
| 3,856,033 | 12/1974 | Strain et al. | 137/3 |
| 3,924,648 | 12/1975 | Etter | 137/3 |
| 3,948,281 | 4/1976 | Strain et al. | 137/3 |
| 3,986,846 | 10/1976 | Bivins, Jr. | 137/100 X |
| 4,019,523 | 4/1977 | Clark et al. | 137/7 |
| 4,062,373 | 12/1977 | Clark et al. | 137/3 |
| 4,142,860 | 3/1979 | Mayeaux | 137/557 |
| 4,254,797 | 3/1981 | Mayeaux | 137/565 |
| 4,257,438 | 3/1981 | Miller | 137/88 |
| 4,257,439 | 3/1981 | Mayeaux | 137/88 |
| 4,290,296 | 9/1981 | Bredeweg et al. | 73/1 G |
| 4,349,358 | 9/1982 | Tarancon | 137/7 X |
| 4,404,984 | 9/1983 | Jones | 137/88 |
| 4,449,543 | 5/1984 | Greene, Jr. | 137/3 |
| 4,526,188 | 7/1985 | Olsson et al. | 137/3 |
| 4,615,352 | 10/1986 | Gibot | 137/7 |
| 4,634,559 | 1/1987 | Eckert | 137/3 X |
| 4,827,965 | 5/1989 | Wates | 137/88 |
| 4,829,183 | 5/1989 | McClatchie et al. | 250/346 |
| 4,897,226 | 1/1990 | Hoyle et al. | 141/11 X |
| 4,915,123 | 4/1990 | Morgovsky et al. | 137/599 |
| 4,921,020 | 5/1990 | Pamper | 141/20 |
| 4,937,448 | 6/1990 | Mantz et al. | 250/343 |
| 4,938,256 | 7/1990 | Wiegleb et al. | 137/565 |
| 4,975,582 | 12/1990 | Mount et al. | 250/343 |
| 5,054,309 | 10/1991 | Mettes et al. | 73/1 G |
| 5,056,547 | 10/1991 | Brownawell | 137/3 |
| 5,063,275 | 11/1991 | Rosenfeld et al. | 73/1 G |
| 5,156,776 | 10/1992 | Loedding et al. | 261/27 |
| 5,325,852 | 7/1994 | Clem | 137/91 |

*Primary Examiner*—J. Casimer Jacyna
*Attorney, Agent, or Firm*—Dykema Gossett

[57] ABSTRACT

A system for continuously filling a plurality of cylinders with a precise concentration of a vaporized liquid component blended into a gas is disclosed wherein the concentration of the liquid component of the resultant final blended mixture is continuously analyzed, and immediately adjusted, during the filling process. Due to the constant analysis and adjustment, any error in the concentration of a component is typically realized before the concentration is outside an acceptable range. The inventive system allows for a large number of cylinders to be accurately and quickly filled with the compressed, final blended mixture.

20 Claims, 2 Drawing Sheets

SYSTEM FOR CONTINUOUS BLENDING OF A LIQUID INTO A GAS

FIELD OF THE INVENTION

The present invention relates generally to a system for continuously blending a liquid into a gas, and more particularly, to a system for filling a plurality of cylinders with the final blended mixture while simultaneously analyzing and adjusting the mixture.

BACKGROUND OF THE INVENTION

A calibration mixture contains a precise, known quantity of a component gas, or component gases, and is typically used to verify a concentration reading from an analyzer or similar equipment. In some instances, a precise concentration of a liquid component is vaporized and blended into the mixture, so that the liquid component may also be used for calibration, or similar purposes. The concentration of the liquid component, in this instance, must be known within a precise range. Typically, the concentration of the liquid component in the mixture is sufficiently low, so that the liquid component remains vaporized at a given temperature and pressure within a storage vessel, such as a cylinder.

The individual cylinders filled with the final blended mixture must be analyzed to assure integrity of each individual cylinder, and to assure that the concentration of the components are within an acceptable range. Typically, a batch filling process is used to fill the individual cylinders with the final blended mixture. Often, each individual cylinder is separately and individually analyzed after the filling process, which is time consuming and expensive. If the final blended mixture does not contain the desired concentration of components, several of the cylinders may be filled with an incorrect mixture before realizing the error. Further, with the batch filling process, a cylinder may be contaminated during the lag time between evacuating the cylinder and filling the cylinder with the final blended mixture.

A goal of the present invention is to provide a system for continuously blending a liquid component in a gas mixture that allows for constant analysis and adjustment during the filling of a plurality of cylinders. A further goal of the invention is to provide an accurate and economical system for continuously filling a plurality of cylinders with a final blended mixture, which comprises at least one gas component and at least one component which is a liquid at ambient temperature and pressure.

SUMMARY OF THE INVENTION

A system for continuously filling a plurality of cylinders with a precise concentration of a liquid component blended in a gas is disclosed wherein the concentration of the liquid component of the final blended mixture is continuously analyzed, and immediately adjusted, during the filling process. Additional gaseous components may also be added, forming an intermediate mixture prior to injection of the liquid component. The additional gaseous components are likewise continuously analyzed and adjusted during the filling process. Due to the constant analysis and adjustment, any error in the concentration of a component is typically realized before the concentration is outside an acceptable range. The inventive system allows for a large number of cylinders to be accurately and quickly filled with the compressed, final blended mixture.

One embodiment of the system includes a liquid injection apparatus which pumps a liquid into a gas mixture. The liquid is injected in between compression and cooling of the gas mixture so that the liquid is vaporized and blended when the temperature of the gas mixture is increased due to the compression.

The inventive system, which includes these and other features of the present invention, can be best understood from the following specification and drawings, of which the following is a brief description.

DETAILED DESCRIPTION OF THE PREFERRED EMBODIMENT

Figure 1:
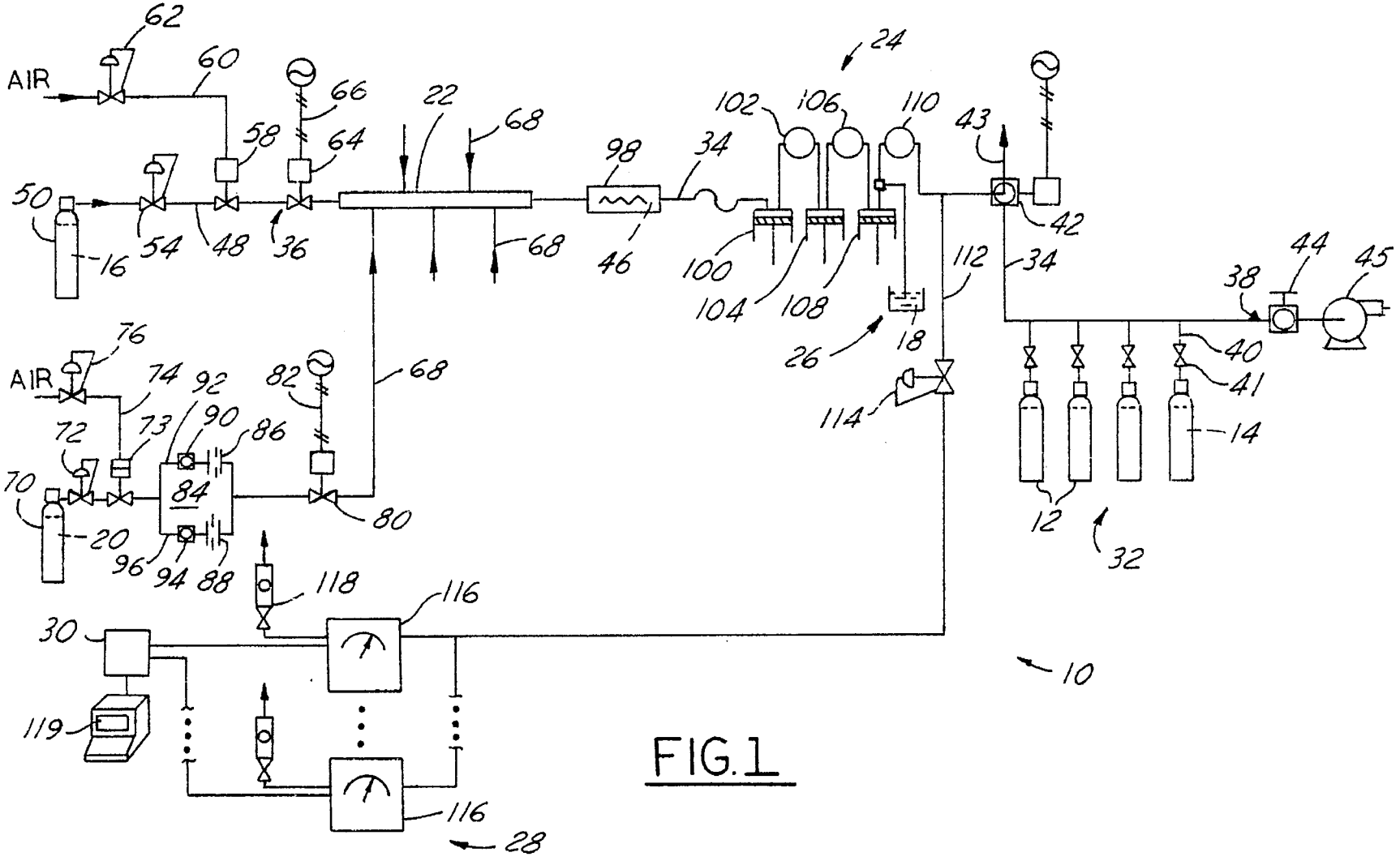
FIG. 1 is a schematic view of a system for providing a plurality of cylinders with a final blended mixture.

Referring now to the drawings, FIG. 1 illustrates a cylinder filling system 10 for filling a plurality of cylinders 12 with a compressed, final blended mixture 14. Final blended mixture 14 is a combination of a balance gas 16 blended with at least one liquid component 18. Final blended mixture 14 may also include one or more gaseous components 20 and additional liquid components 18 at a desirable high pressure. For the purposes of this disclosure, liquid component 18 is a liquid at ambient temperature and ambient pressure, and gas component 20 is a gas at ambient temperature and cylinder pressure. Ambient temperature is considered to be approximately between 40 degrees F. and 110 degrees F. Ambient pressure is considered to be approximately between 730 mm Hg and 780 mm Hg. Cylinders 12 may be any type of storage container suitable for containment of the final blended mixture. Cylinder 12 pressure is in the approximate range of 100 psig to 2800 psig.

Cylinder filling system 10 is comprised essentially of a gas blending apparatus 22, a compression apparatus 24, a liquid injection apparatus 26, an analyzing apparatus 28, a control apparatus 30, and a filling apparatus 32. For simplicity, a primary fill line 34 is shown, which contains the mixture in a controlled environment from gas blending apparatus 22 to filling apparatus 32. Pressure from an upstream end 36 of primary fill line 34 to a downstream end 38 is maintained by the compression apparatus 28.

Filling apparatus 32 includes a plurality of conduits 40, each conduit 40 extending to one of the plurality of cylinders 12. Conduit 40 extends from primary fill line 34, and a valve 41 located on each conduit allows for selective flow to each respective cylinder. Filling apparatus 22 includes a remotely operated valve 42 to direct the flow of the mixture either to a vent 43 during a period of adjustment or to primary fill line 34 when the mixture has the desired composition.

To initialize the system, cylinders 12 are first evacuated through a valve 44 using a vacuum pump 45, and, as required, purged with an appropriate gas. Immediately following evacuating and/or purging of cylinders 12, and when the final blended mixture composition is properly adjusted, the compression and filling process begins. Consolidation of these processes into a combined system eliminates the risk of contamination of the cylinders 12.

The blending process for formation of final blended mixture 14 typically involves two primary phases. The first phase is unnecessary if no additional gas component is added to balance gas 16. In the first phase, one or more gas components 20 are blended in balance gas 16, at relatively low pressure. Upon exiting gas blending apparatus 22, an intermediate mixture 46 is formed. In the second phase of the blending process, at least one liquid component 18 is added to the intermediate mixture 46, forming the final blended mixture 14. The gas components blended in the first phase typically are selected from oxygen, carbon dioxide, carbon monoxide, a gaseous hydrocarbon, nitric oxide and sulfur dioxide. The liquid component may be ethanol, methanol, hexane, or other components which are a liquid at ambient temperature and ambient pressure. Balance gas 16 is typically nitrogen, but may be any gas inert with respect to the hydrocarbons or other constituents of the components to be blended.

In the illustrative embodiment, balance gas 16 is supplied to primary fill line 34 by way of a balance gas feed line 48 from a supply vessel 50. Downstream pressure is established by compression apparatus 24. The pressure of balance gas 16 is controlled, in part, by a pressure regulator 54, which is able to substantially lower the pressure of balance gas 16 from supply vessel 50. The pressure of balance gas 16 is further controlled by air pressure applied to a dome loaded pressure regulator 58 through an air feed line 60. The pressure in air feed line 60 is controlled remotely through a pressure regulator 62 which is controlled on control apparatus 30. Upstream of gas blending apparatus 22, a solenoid valve 64 may be opened or closed to allow for flow of balance gas 16 into primary fill line 34, and subsequently into gas blending apparatus 22. Solenoid valve 64 includes an electrical line 66, so that its operation may be controlled from control apparatus 30, which is remotely located.

Gas blending apparatus 22 is a blending manifold capable of blending five or more component gases at approximately 5 psig. Each gas component 20 is added at gas blending apparatus 22 through a secondary feed line 68, although only one secondary feed line 68 will be described for the typical gas component 20.

Component 20 may be a pure gas, or a predetermined mixture of pure gas and balance gas 16. Gas component 20 enters secondary feed line 68 from a supply vessel 70. The pressure of gas component 20 is controlled, in part, by a pressure regulator 72, which is able to substantially lower the pressure of gas component 20 from supply vessel 70. The pressure of gas component 20 is further controlled by air pressure applied to a dome loaded pressure regulator 73 through an air feed line 74. The pressure in air feed line 74 is controlled remotely through a pressure regulator 76 which is controlled on control apparatus 30. Upstream of gas blending apparatus 22, a solenoid valve 80 may be opened or closed to allow for flow of gas component 20 into primary fill line 34, and subsequently into gas blending apparatus 22. Solenoid valve 80 includes an electrical line 82, so that its operation may be controlled from control apparatus 30.

For precise control of the concentration of gas component 20, an orifice unit 84 is located on secondary feed line 68 upstream of solenoid valve 80. Orifice unit 84 allows component 18 to flow over a first orifice 86 or a second orifice 88, or both orifices for a wide range of flow rates. A ball valve 90 on a first orifice line 92 permits flow through first orifice 86. A ball valve 94 on a second orifice line 96 permits flow through second orifice 88. Generally, the absolute pressure upstream of orifices 86 and 88 is more than twice the absolute downstream pressure in secondary feed line 68. This causes the flow of gas component 20 through orifices 86 and 88 to be at sonic velocity so that any fluctuations in downstream pressure in blending apparatus 22 will not affect the flow rate of gas component 20.

Secondary feed line 68 terminates at a distinct location on gas blending apparatus 22. Each secondary feed line terminates on gas blending apparatus 22 at a location spaced from the other secondary feed lines. Adding of the gas components in this manner assists in the blending of the gas components, and helps to prevent distinct streams of the components within gas blending apparatus 22. Additionally, a static mixer 98 is located on primary fill line 34 downstream of gas blending apparatus 22 to agitate intermediate mixture 46 to assure a complete blending of the gas components.

Downstream of static mixer 98 in primary fill line 34, intermediate mixture 46 is directed to compression apparatus 24. In a preferred embodiment, compression apparatus 24 is a three cylinder, water cooled, oil-free compressor for compression up to 2800 psig. Intermediate mixture 46 is compressed and cooled in three stages by a first cylinder 100, a first cooler 102, a second cylinder 104, a second cooler 106, a third cylinder 108 and a third cooler 110. The compression by first cylinder 100 is approximately 100 psig; the compression by second cylinder 104 is approximately 600 psig; and the compression by third cylinder 108 is approximately 2800 psig. The temperature of intermediate mixture 46 is increased during compression, necessitating cooling after each compression stage. In one known embodiment, compression apparatus 24 is a Rix Model 3KX3BG-44.

The second phase of blending the final blended mixture 14 involves the injection of liquid component 18 into intermediate mixture 46. It is desirable to inject liquid component 18 when intermediate mixture 46 is at a temperature sufficient to vaporize the liquid. Depending on the properties of the liquid, the temperature of intermediate mixture 46 in compression apparatus 24 is sufficient to vaporize liquid component 18. To take advantage of this situation, liquid injection apparatus is coupled to the primary feed line 34 after one of the cylinders prior to being cooled. As shown, liquid injection apparatus 26 is coupled to primary fill line 34 between third cylinder 108 and third cooler 110.

Upstream of filling apparatus 32, after formation and cooling of final blended mixture 14, a sample of final blended mixture 14 is bled from primary fill line 34 to an analyzer line 112. A regulator 114 on analyzer line 112 reduces the pressure of the sample flow to analyzer apparatus 28. A separate analyzer 116 is provided for each component of final blended mixture 14 to be analyzed. Each analyzer 116 includes a valve/flow meter 118 for control of the sample through the analyzer. In some instances, a Fourier transform, infra red (FTIR) analyzer or mass spectrometer may be used to continuously analyze multiple components.

Control apparatus 30 is in communication with each analyzer 116. Information from each analyzer 116 is thereby compiled, and by use of a database and a computer, a determination may be made if each component is within a desired range. A display terminal 119 displays the instantaneous component concentration, and the average concentration over a given period of time. If a concentration level is outside a predetermined acceptable range, the flow conditions are appropriately adjusted either manually or automatically. Some of this information is a result of gauges which monitor pressure throughout the system, which are not shown in order to simplify the schematic diagrams. An operator for the system is notified if a given pressure or temperature is outside a predetermined range by reading display terminal 119. The various types of regulators, valves and gauges used in the system are conventional items known to those skilled in the art. Upon a determination that each component of final blended mixture 14 is within an acceptable concentration, and that cylinder filling system 10 is operating properly, cylinders 12 are filled with the compressed final blended mixture 14.

The concentration of final blending mixture 14 is continuously analyzed while the cylinders are being filled. Adjustments in the concentration are made as necessary during the filling process, allowing for continuous analysis and immediate adjustment to the concentration level of liquid component 18 and gas component 20. Because all cylinders 12 are filled at once, all the cylinders will have the same concentration. As a final check, after all of the plurality of cylinders 12 are filled, the mixture in one or more of the cylinders is analyzed to confirm the composition of the mixture.

Figure 2:
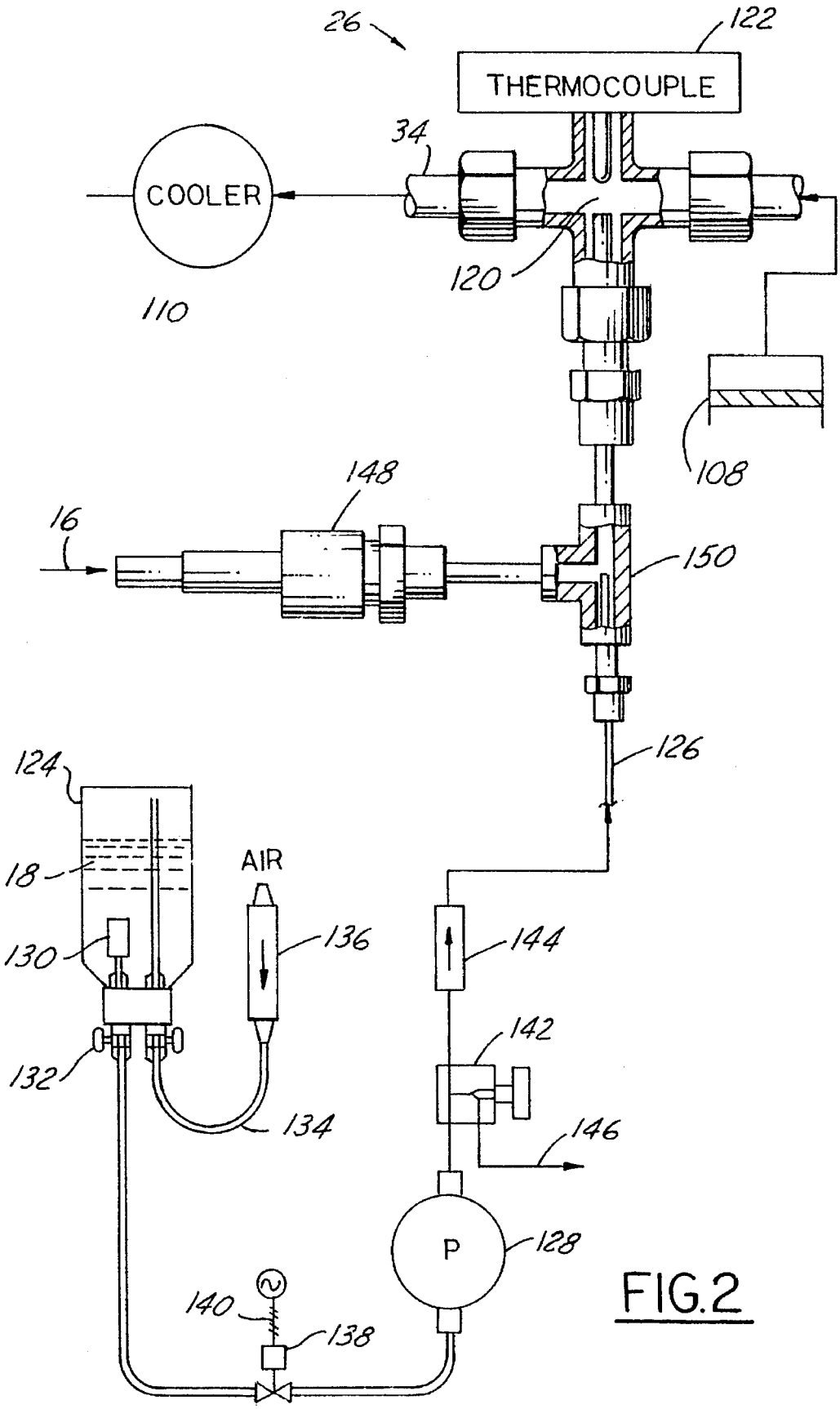
FIG. 2 is a schematic view of one embodiment of a liquid blending apparatus in combination with the inventive system of FIG. 1.

FIG. 2 illustrates one embodiment of liquid injection apparatus 26, illustrating a metering pump system. A mixing area 120 of liquid injection apparatus 26 is in primary fill line 34 between third cylinder 108 and third cooler 110. A thermocouple 122 is immediately adjacent mixing area 120 to assist in monitoring the temperature, which is approximately 400 degrees F. The temperature in mixing area 120 is critical to properly vaporize liquid component 18. Liquid component 18, such as ethanol, is a liquid at ambient temperature and pressure, and is stored in a reservoir 124. A liquid feed line 126 extends between mixing area 120 and reservoir 124. Liquid component 18 is fed to mixing area 120 by use of a metering pump 128 located on liquid feed line 126. In one known embodiment, metering pump 128 is an Eldex, Model A-60-S-2, piston metering pump with a micrometer stroke length adjustment. The maximum flow capacity is 1.5 milliliter per minute at a maximum pressure of 2500 psig.

The liquid component 18 is passed through a filter 130 and a shut off valve 132 before entering liquid feed line 126. An air tube 134 is provided so that air may replace the displaced liquid within reservoir 124. A drying tube 136 is provided on air tube 130 for moisture control of the air. Upstream of metering pump 128, a solenoid valve 138 may be opened or closed to allow for flow of liquid component 18. Solenoid valve 138 includes an electrical line 140, so that operation of the solenoid valve may be controlled from control apparatus 30.

In conjunction with metering pump 128, a purge valve 142 and a check valve 144 assist in controlling the flow of liquid component 18. Liquid is bled at 146 downstream of pump 128 to remove any trapped air bubbles, while check valve 144 assures one way flow. Check valve 144 further helps to minimize fluctuations in the concentration of liquid component 18, and increases the back pressure on the compressor when the pressure in the fill cylinder is low. Liquid injection apparatus 26 further includes a balance gas feed line 148, connected to liquid feed line 126 at a tee connector 150. Tee connector 150 is upstream of mixing area 120. A high pressure stream of balance gas 16 of approximately 1500 psig is provided at balance gas feed line 148 for further control of the flow rate of liquid component 18. The stream of balance gas 16 assists with the vaporization and dispersion of the liquid component and reduces the possibility of chemical reaction with the hot intermediate mixture. In some instances, balance gas feed line 148 is not required.

Metering pump 128 provides a continuously adjustable flow with a range suitable for the desired concentration of liquid component 18 in final blended mixture 14. Metering pump 128 must also be able to generate sufficient pressure to feed the liquid into the system at the desired entry point, namely mixing area 120.

In summary, the inventive method of filling a plurality of cylinders with a final blended mixture includes the steps as herein described. The final blended mixture contains a gas component as a balance gas and at least one vaporized liquid component, the gas component being a gas at an ambient pressure and temperature, and the liquid component being a liquid at ambient pressure and temperature. An additional gas component may also be blended with the balance gas prior to adding the liquid component. A concentration of each component is analyzed and adjusted simultaneously with the filling of the plurality of cylinders. The method comprises the steps of:

1) flowing a balance gas through a primary fill line, the balance gas being at an initial temperature and being at an initial pressure;

2) regulating the pressure of the balance gas to a first pressure, the first pressure being less than the initial pressure;

3) flowing an additional gas component into a secondary feed line;

4) regulating the pressure of the additional gas component in the secondary feed line to approximately equal the first pressure;

5) blending the additional gas component with the balance gas in a blending apparatus at the first pressure, thereby forming an intermediate mixture;

6) compressing the intermediate mixture downstream of the blending apparatus, whereby the pressure of the intermediate mixture is increased to a second pressure, the second pressure being greater than the first pressure, whereby the increase in pressure of the intermediate mixture results in an increase in temperature to a vaporizing temperature, the vaporizing temperature being a temperature wherein the liquid component is vaporized;

7) injecting the liquid component into the intermediate mixture after the compressing step when the intermediate mixture is at the vaporizing temperature, thereby forming the final blended mixture;

8) cooling the final blended mixture;

9) flowing a sample of the final blended mixture to an analyzer apparatus, wherein the concentration of the components are analyzed;

10) determining if the concentration of the components are within predetermined ranges;

11) adjusting a respective flow rate for each of the components until the concentration of each respective component is within its predetermined range;

12) filling the plurality of cylinders with the final blended mixture after adjusting the flow rate of each component;

13) filling the plurality of cylinders with the final blended mixture; and 14) bleeding a sample of the final blended mixture to the analyzer apparatus simultaneously with the filling of the plurality of cylinders, wherein the following substeps are performed simultaneously with the filling of the cylinders: determining if the concentration of each of the respective components of the final blended mixture are within its predetermined range; and adjusting the flow rate of each respective component until the concentration is within its predetermined range.

Alternative embodiments of liquid injection apparatus 26 include a permeation tube system, a bubbler system, and a restrictive orifice system, none of which are illustrated in the drawings. These alternative systems may be used depending on the characteristics of the specific liquid component being blended, and the desired concentration of the liquid component in the final blended mixture 14.

The permeation tube system includes a tube containing the liquid component 18. The tube is constructed of a material that allows for permeation of the liquid component through a wall of the tube at a constant rate dependent on its temperature. The permeation tube is placed at an appropriate location within primary fill line 34. The concentration of liquid component 18 is controlled by adjustment of its temperature in the permeation tube. To obtain higher concentrations, several permeation tubes are used in parallel.

The bubbler system includes a reservoir of liquid component 18. The reservoir is heated to a temperature which is controllable. An inlet dip tube allows the balance gas 16 to flow into the reservoir and to the bottom of the liquid component. After bubbling up through the liquid component, the balance gas 16 is saturated with the liquid component. The saturated balance gas is then blended with intermediate mixture 46 at the desired concentration. With the bubbler system, it is generally difficult to control the precise concentration of the liquid component. Accordingly, the system is used only if the liquid component is not available in a permeation tube, or is unsuitable for use with the metering pump 128.

With the restrictive orifice system, the liquid component is stored in a reservoir at a controlled temperature. The vapor area of the reservoir is connected to a line containing a restrictive orifice. The temperature of the liquid in the reservoir is high enough to assure a maximum flow through the orifice. The line from the reservoir connects to primary fill line 34 upstream of compressor apparatus 24 in order to blend with intermediate mixture 46.

The embodiments disclosed herein have been discussed for the purpose of familiarizing the reader with the novel aspects of the invention. Although preferred embodiments of the invention have been shown and described, many changes, modifications and substitutions may be made by one having ordinary skill in the art without necessarily departing from the spirit and scope of the invention as described in the following claims.

What is claimed is:

1. A method of filling a plurality of cylinders with a final blended mixture containing a gas component as a balance gas and at least one vaporized liquid component, the gas component being a gas at an ambient pressure and an ambient temperature, the liquid component being a liquid at said ambient pressure and said ambient temperature, said method comprising the steps of:

1) flowing a balance gas through a primary fill line, said balance gas being at an initial temperature and being at an initial pressure;

2) regulating the pressure of said balance gas to a first pressure;

3) compressing said balance gas, whereby the pressure of said balance gas is increased to a second pressure, said second pressure being greater than said first pressure, whereby the increase in pressure of said balance ass results in an increase in temperature to a vaporizing temperature, said vaporizing temperature being a temperature wherein said liquid component is vaporized;

4) injecting said liquid component into said balance gas after said compressing step when said balance gas being at said vaporizing temperature, thereby forming said final blended mixture;

5) cooling said final blended mixture; and 6) filling said plurality of cylinders with said final blended mixture.

2. The method of claim 1, wherein the following steps are performed prior to said compressing step:

flowing an additional gas component in a secondary feed line;

regulating the pressure of said additional gas component in said secondary feed line to approximately equal said first pressure; and blending said additional gas component into said balance gas.

3. The method of claim 2, wherein the following steps are performed after said cooling step:

flowing a sample of said final blended mixture to an analyzer apparatus simultaneously with said filling step, wherein the concentration of said additional gas component is analyzed;

determining if said concentration of said additional gas component is within a predetermined range; and adjusting the flow rate of said additional gas component until said concentration is within said predetermined range.

4. The method of claim 2, wherein said first pressure is approximately 5 psig.

5. The method of claim 1 wherein at least two distinct liquid components are injected during said injecting step.

6. The method of claim 1, wherein the following steps are performed after said cooling step:

flowing a sample of said final blended mixture to an analyzer apparatus simultaneously with said filling step, wherein the concentration of said liquid component is analyzed;

determining if said concentration of said liquid component is within a predetermined range; and adjusting the flow rate of said liquid component until said concentration is within said predetermined range.

7. The method of claim 1, wherein said cylinders are evacuated immediately prior to said flowing a balance gas step.

8. The method of claim 1, wherein said ambient temperature is approximately between 40 degrees F. and 110 degrees F., and said ambient pressure is approximately between 730 mm Hg and 780 mm Hg.

9. The method of claim 1, wherein the pressure of said final blended mixture in said plurality of cylinders is in the approximate range of 100 psig and 2800 psig.

10. The method of claim 1, wherein said balance gas is nitrogen and said liquid component is ethanol.

11. The method of claim 1, wherein said balance gas is nitrogen and said liquid component is methanol.

12. A method of filling a plurality of cylinders with a final blended mixture, said final blended mixture containing a gas component as a balance gas and at least one vaporized liquid component, the gas component being a gas at an ambient pressure and an ambient temperature, the liquid component being a liquid at said ambient pressure and said ambient temperature, wherein a concentration of said liquid component is analyzed and adjusted simultaneously with said filling of said plurality of said cylinders, said method comprising the steps of:

1) flowing a balance gas through a primary fill line, said balance gas being at an initial temperature and being at an initial pressure;

2) regulating the pressure of said balance gas to a first pressure;

3) injecting and vaporizing said liquid component into said balance gas, thereby forming said final blended mixture;

4) compressing one of said balance gas and said final blended mixture within said primary fill line to a second pressure, said second pressure being greater than said first pressure;

5) flowing a sample of said final blended mixture to an analyzer apparatus, wherein the concentration of said liquid component is analyzed;

6) determining if said concentration of said liquid component is within a predetermined range;

7) adjusting a flow rate of said liquid component until said concentration is within said predetermined range;

8) filling said plurality of cylinders with said final blended mixture after adjusting said flow rate of said liquid component; and 9) bleeding a sample flow of said final blended mixture to said analyzer apparatus simultaneously with said filling of said plurality of cylinders step, wherein the following substeps are performed simultaneously with the filling of said plurality of cylinders: determining if said concentration of said liquid component is within said predetermined range; and adjusting said flow rate of said liquid component until said concentration is within said predetermined range.

13. The method of claim 12, wherein the following steps are performed prior to said injecting step:

flowing an additional gas component in a secondary feed line;

regulating the pressure of said additional gas component in said secondary feed line to approximately equal said first pressure; and blending said additional gas component into said balance gas.

14. The method of claim 12, wherein said ambient temperature is approximately between 40 degrees F. and 110 degrees F., and said ambient pressure is approximately between 730 mm Hg and 780 mm Hg.

15. The method of claim 12, wherein the pressure of said final blended mixture in said plurality of cylinders is in the approximate range of 100 psig and 2800 psig.

16. The method of claim 12, wherein said cylinders are evacuated immediately prior to said flowing a balance gas step.

17. The method of claim 12, wherein said balance gas is nitrogen and said liquid component is ethanol.

18. The method of claim 12, wherein said balance gas is nitrogen and said liquid component is methanol.

19. A system for filling a plurality of cylinders with a final blended mixture, said final blended mixture containing a gas component as a balance gas and at least one vaporized liquid component, the gas component being a gas at an ambient pressure and an ambient temperature, the liquid component being a liquid at said ambient pressure and said ambient temperature, wherein a concentration of said liquid component is analyzed and adjusted simultaneously with said filling of said plurality of said cylinders, said system being comprised of:

a primary fill line;

a balance gas feed line having a regulation means for regulating a flow of a balance gas into said primary fill line, said balance gas being at an initial temperature and being at an initial pressure;

a blending apparatus on said primary fill line, wherein an intermediate mixture flows from said blending apparatus, and wherein an additional gas component is blended with said balance gas in said blending apparatus;

a secondary feed line connected to said blending apparatus, said secondary feed line providing said additional gas component, said secondary feed line having a regulation means for regulating a flow of said additional gas component;

a compression apparatus on said primary fill line downstream of said blending apparatus, said compression apparatus providing for compression of said intermediate mixture;

a liquid injection apparatus on said primary fill line for injecting a liquid component thereby forming a final blended mixture, said liquid injection apparatus having a regulation means for regulating a flow of said liquid component;

a bleed line downstream of said liquid injection apparatus, said bleed line flowing a sample of said final blended mixture to an analyzer, said an analyzer determining if a concentration of said additional gas component is within a first predetermined range, and determining if a concentration of said liquid component is within a second predetermined range;

a computer means in communication with said analyzer, said computer means assisting in the adjustment of the flow of said additional gas component until said concentration is within said first predetermined range, and said computer means assisting in the adjustment of the flow said liquid component until said concentration is within said second predetermined range; and a cylinder filling apparatus for filling said plurality of cylinders with said final blended mixture.

20. The system of claim 19, wherein said liquid injection apparatus injects said liquid component into said primary fill line immediately following compression of said intermediate mixture prior to cooling of said intermediate mixture.

* * * * *

UNITED STATES PATENT AND TRADEMARK OFFICE

CERTIFICATE OF CORRECTION

PATENT NO. : 5,495,875

DATED : March 5, 1996

INVENTOR(S) : Michael A. Benning and Stephen B. Miller

It is certified that error appears in the above-identified patent and that said Letters Patent is hereby corrected as shown below:

Column 7, line 62, "ass" is changed to --gas--.

Signed and Sealed this

Thirtieth Day of July, 1996

*Attest:*

*Attesting Officer*

BRUCE LEHMAN

*Commissioner of Patents and Trademarks*